US012404089B2

(12) United States Patent
Bressan

(10) Patent No.: US 12,404,089 B2
(45) Date of Patent: Sep. 2, 2025

(54) CONTAINER FOR AMPOULES OR SYRINGES

(71) Applicant: ALTERGON S.A., Lugano (CH)

(72) Inventor: Michel Bressan, Viggiu' (IT)

(73) Assignee: ALTERGON SA, Lugano (CH)

( * ) Notice: Subject to any disclaimer, the term of this patent is extended or adjusted under 35 U.S.C. 154(b) by 0 days.

(21) Appl. No.: 18/704,429

(22) PCT Filed: Oct. 25, 2022

(86) PCT No.: PCT/EP2022/079687
§ 371 (c)(1),
(2) Date: Apr. 24, 2024

(87) PCT Pub. No.: WO2023/072885
PCT Pub. Date: May 4, 2023

(65) Prior Publication Data

US 2025/0033865 A1 Jan. 30, 2025

(30) Foreign Application Priority Data

Oct. 25, 2021 (IT) ..... 102021000027296
Dec. 23, 2021 (KR) ..... 10-2021-0186136

(51) Int. Cl.
*B65D 85/42* (2006.01)
*B65D 5/50* (2006.01)
(Continued)

(52) U.S. Cl.
CPC ..... *B65D 85/42* (2013.01); *B65D 5/503* (2013.01); *B65D 75/5833* (2013.01)

(58) Field of Classification Search
CPC .... B65D 5/0227; B65D 5/503; B65D 5/5435; B65D 51/20; B65D 75/5833; B65D 85/42
(Continued)

(56) References Cited

U.S. PATENT DOCUMENTS 5,226,532 A 7/1993 Davidson et al.
5,762,192 A * 6/1998 Jacobs ..... A61C 7/12 206/63.5
(Continued)

FOREIGN PATENT DOCUMENTS

DE 102010020254 A1 11/2011
FR 1501985 A 11/1967
(Continued)

OTHER PUBLICATIONS

International Search Report and Written Opinion for Application No. PCT/EP2022/079687, dated Feb. 23, 2023, 10 pages.

*Primary Examiner* — Luan K Bui
(74) *Attorney, Agent, or Firm* — Brooks Kushman P.C.

(57) ABSTRACT

An improved container for ampoules or syringes has a primary case with at least one opening closable via a primary lid, a tray with a plurality of seats to accommodate the same number of ampoules or syringes, and a secondary lid which defines, inside said primary case, a secondary case which, in turn, accommodates in its interior said tray. When said tray is inserted inside said secondary case, the ampoules or syringes contained therein face towards the inner face of said secondary lid. The secondary lid defines, at each ampoule or syringe below it, an access opening closed by a removable closure portion. Each closure portion has a gripping zone defined by means of a further transverse break line that the user can break by applying pressure at the surface of the gripping zone and more easily remove the closure portion in order to access the underlying ampoule or syringe.

9 Claims, 3 Drawing Sheets

(51) Int. Cl.
*B65D 5/54* (2006.01)
*B65D 75/58* (2006.01)

(58) Field of Classification Search
USPC ..... 206/63.3, 363, 364, 369, 370, 380, 438, 206/528; 229/120.21, 242, 244
See application file for complete search history.

(56) References Cited

U.S. PATENT DOCUMENTS

| | | | | |
|---|---|---|---|---|
| 5,934,460 | A * | 8/1999 | Schmid | A61C 5/66 206/63.5 |
| 7,424,952 | B2 * | 9/2008 | Antler | A61C 15/00 229/87.01 |
| 2005/0121359 | A1 * | 6/2005 | Lo Duca | B65D 85/42 206/775 |
| 2015/0297296 | A1 * | 10/2015 | Stauder | B65D 77/0413 206/370 |
| 2016/0198990 | A1 * | 7/2016 | Betancur | B01L 9/06 206/363 |
| 2024/0150078 | A1 * | 5/2024 | Marini | B32B 27/10 |

FOREIGN PATENT DOCUMENTS

| | | | |
|---|---|---|---|
| FR | 2734795 | A1 | 12/1996 |
| WO | 2014006207 | A1 | 1/2014 |

* cited by examiner

CONTAINER FOR AMPOULES OR SYRINGES

CROSS-REFERENCE TO RELATED APPLICATION

This application is the U.S. national phase of PCT Application No. PCT/EP2022/079687 filed Oct. 25, 2022 which, in turn, claims priority to Italian Patent Application No. 102021000027296 filed Oct. 25, 2021 and Korean Patent Application No. 10-2021-0186136 filed Dec. 23, 2021, the disclosures of which are hereby incorporated in their entirety by reference herein.

FIELD OF THE INVENTION

The present invention relates to an improved container for ampoules, syringes or similar casings containing products, such as for example but not necessarily pharmaceutical products.

The container according to the present invention offers numerous advantages compared to containers of the known type, and in particular is particularly effective in retaining ampoules or syringes in a more stable manner, in allowing identification of individual ampoules or syringes, and in preserving the product contained in said ampoules or syringes from exposure to light, which in the case of many products is harmful.

STATE OF THE ART

Containers configured to hold one or more ampoules or syringes are known on the market, which containers generally comprise a containing case which is usually made of cardboard and opens like a casket and which houses in its interior a tray or box, which may be made of the same material as the containing case or of plastic material, and which in turn comprises a plurality of seats, or blister cells, preformed to hold the same number of ampoules or syringes.

WO 2014/006207 discloses an improved container comprising a primary case provided with an opening, and a tray comprising a plurality of seats for accommodating a plurality of ampoules or syringes according to the pre-characterising portion of claim 1.

However, these containers of the known type have certain disadvantages.

A first disadvantage consists of the fact that with containers of the known type, when the user has to access an ampoule or syringe, they have necessarily to open the containing case which, by opening like a casket, allows access to the ampoules or syringes. In this way, however, all the ampoules or syringes placed inside said tray are exposed to the light.

In many cases, exposure to light of the product, such as a pharmaceutical or cosmetic product for example, is damaging for the product itself.

The same Applicant has carried out some laboratory tests, in particular tests of photostability of pharmaceutical products contained inside ampoules, performed according to the CPMP/ICH/279/95 directive which provides for exposure to the light generated by a fluorescent lamp emitting cold white light according to the specifications of ISO 10977 and by a fluorescent UV lamp with a spectral distribution between 320 and 400 nm with a maximum emission energy comprised between 350 and 370 nm.

By way of example, tests carried out on the proprietary product IBSA Prolutex 25 mg (ratio 2.2) Solution for injection show that the titre results of samples exposed to light show a gradual downward trend compared to the control samples, defined as "dark".

The same trend was shown for the pH test: the samples exposed to light show a pH value well below that of the dark sample and that of the non-stressed product.

On the basis of the trend found for the progesterone titre test and for the pH test of the solution and considering that both the main pharmacopoeias (EP and USP) lay down that progesterone be stored in containers that protect it from light, it must be concluded that the tested product should be carefully stored in its secondary packaging away from light.

The same obviously applies to many products, particularly but not only pharmaceuticals or cosmetics.

There is therefore a need felt in the sector for having packaging that allows the product contained in ampoules or syringes to be kept away from light until it is used.

A further disadvantage of known containers relates to the fact that, when the user accesses the ampoules or syringes contained therein, opening the containing case, they expose the ampoules or syringes to the risk that they may come out of the housing seats of the tray placed inside the case.

Last but not least, a disadvantage that afflicts containers of the known type consists of the fact that the container does not allow identification of individual ampoules or syringes from among all those contained in the tray.

SUMMARY OF THE INVENTION

In light of the above, the task of the present invention is to overcome the disadvantages that affect containers for ampoules or syringes of the known type.

More particularly, within the scope of this task, an object of the present invention is to provide an improved container for ampoules or syringes capable of eliminating exposure to light of the ampoules or syringes contained therein up to the time when they are used, avoiding exposure to light of all the ampoules or syringes contained therein whenever the lid of the container is opened to take out an ampoule or syringe.

Another object of the present invention is to provide an improved container for ampoules or syringes which allows identification of the individual ampoules or syringes contained therein, in such a way that the user can be guided in the action of withdrawing a specific ampoule, without, however, exposing the other ampoules to light and to the risk of exiting the tray and the container.

A further object of the invention is to provide an improved container for ampoules or syringes, which allows more easily accessing and removing the ampoule or syringe contained therein, without exposing the ampoules to light and to the risk of exiting the tray and the container.

This task and these and other objects are achieved by an improved container for ampoules or syringes according to claim 1.

Further features of the improved container for ampoules or syringes according to the present invention are the subject of the dependent claims.

LIST OF DRAWINGS

Further features and advantages will be made clearer by the following description by way of a non-limiting example of a preferred embodiment of the present invention which will be given here below with the aid of the accompanying drawings wherein.

DETAILED DESCRIPTION OF THE INVENTION

Figure 1:
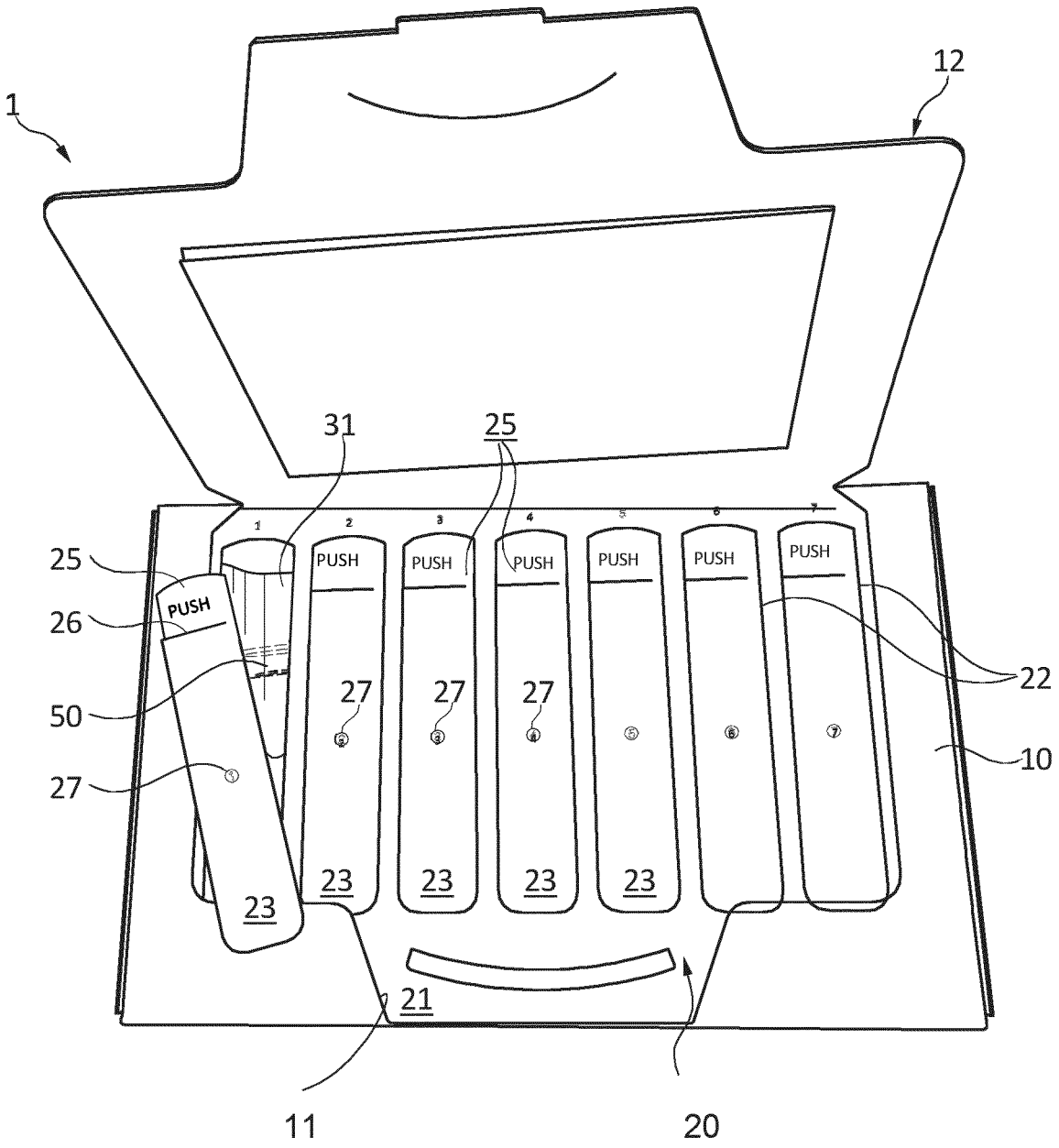
FIG. 1 shows the improved container according to the present invention assembled and partially opened.

Referring in particular to the accompanying drawings, the improved container 1 according to the present invention comprises a containing case 10 having a substantially box-like shape and provided with at least one opening 11, preferably a casket-like opening, closable by means of a primary lid 12, and further comprising a secondary lid 21 which defines, inside said containing case 10, a box-shaped housing 20 suitable for accommodating a tray or box 30, advantageously comprising one or more seats, or cells, 31 preformed to accommodate the same number of ampoules or syringes 50.

Said tray 30 can be made in the same material as the containing case 10 or in plastic material, according to what is known from the state of the art.

Figure 3:
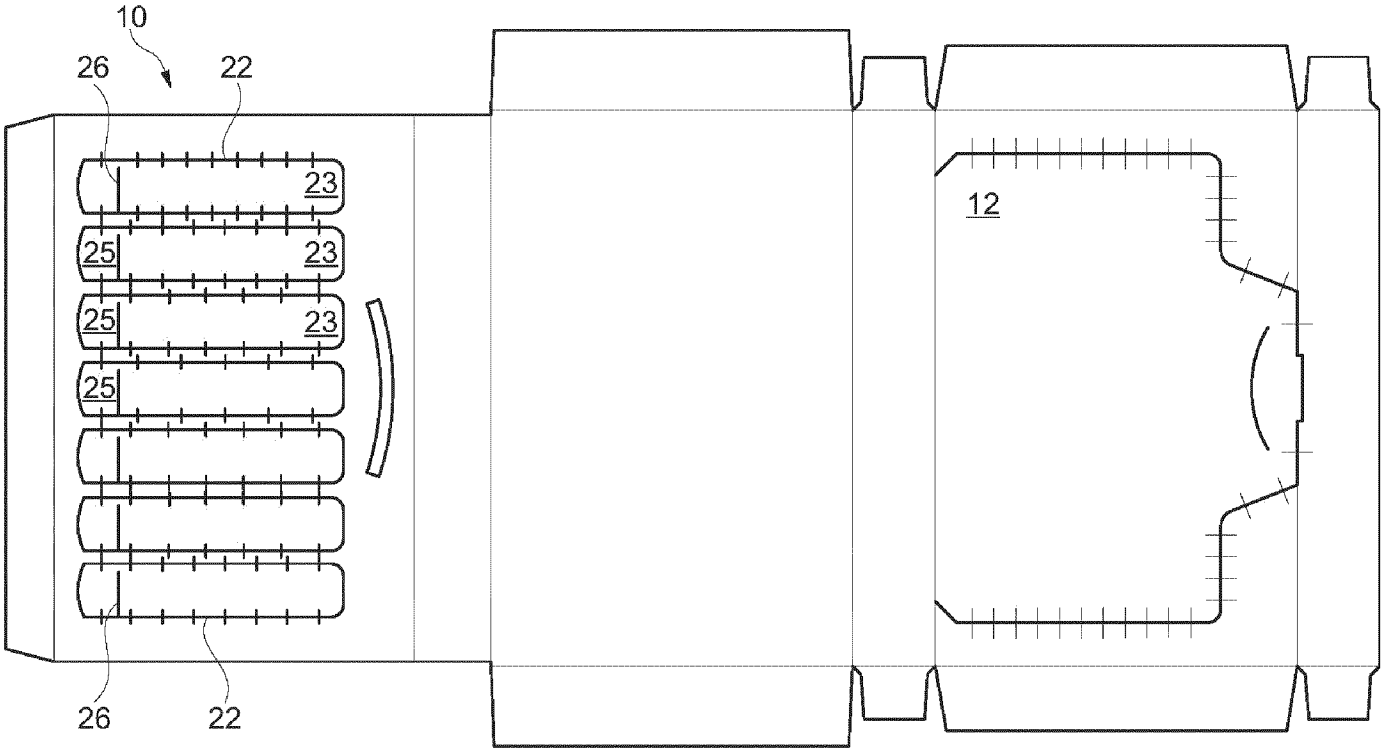
FIG. 3 shows a plan view of the planar development of the container according to the present invention, without the inner tray.

FIG. 3 shows the planar development of the container before it is folded to form the containing case 10 with double lid according to the invention.

Referring in particular to FIG. 1, said housing 20 defined internally to said primary case 10 is box-shaped and comprises said secondary lid 21 which defines a closure surface that rests above said tray 30 when said tray 30 is inserted in said housing 20, so that when container 1 is assembled the ampoules or syringes 50 placed inside the cells 31 of said tray 30 face towards the inner face of said secondary lid 21.

Advantageously, on said secondary lid 21 there are provided, positioned so as to find themselves at the cells 31 which receive said ampoules or syringes 50 when the container is assembled, break lines 22 which each define a closure portion 23 of said secondary lid 21 having a shape substantially corresponding to the underlying cell 31, so as to define in said secondary lid 21 an access opening 24 sufficiently large to allow the user, once the surface of the secondary lid 21 is broken along said break line 22 and said closure portion 23 is removed, to access the underlying ampoule or syringe 50 so as to be able to take it out.

Advantageously, said containing case 10 and said housing 20 are both made in paper material, preferably in card, even more preferably recycled or environmentally sustainable cardboard.

In this way, it is possible to make the container 1 according to the present invention by folding a planar development shaped according to what can be seen in FIG. 3, and advantageously made in a single material, for example like said card, in particular recycled card.

Said planar development is first folded to form the housing 20 closed by the secondary lid 21, and subsequently closed with said primary lid 12 which is superimposed on said secondary lid 21 to form the containing case 10.

Preferably, said break lines 22 are made up of notches in the secondary lid 21 interrupted by connecting elements that keep the closure portion 23, defined by the break line 22, connected to the remaining part of the secondary lid 21.

Even more preferably, each of said closure portions 23 comprises a gripping zone 25 which is advantageously also defined by means of a further break line 26 arranged transversely with respect to the width of the closure portion 23 so that the user can break the further transverse break line 26 by applying pressure at the surface of the gripping zone 25 and more easily remove the closure portion 23 to take out the ampoule or syringe 50 below.

As a result of what has been described so far, and with reference to FIG. 1, on the upper surface of the secondary lid 21 of said secondary containing case 20, which faces towards the exterior when said secondary case 20 is closed, a closure portion 23 is therefore defined at each seat 31 of said ampoules or syringes 50.

Thanks to this configuration, when the user opens the primary lid 12 of the primary case 10, they do not have direct access to the ampoules or syringes 50 which are contained, in the seats 31 of said case 30, inside the secondary containing case 20 which is in turn closed above by said secondary lid 21.

When the primary lid 12 is opened, in fact, the opening 11 makes the secondary lid 21, and in particular its upper surface, visible to the user, and there is no direct access to the ampoules or syringes 50.

In this way, it is ensured that even after opening the lid 12 of the primary case 10, the ampoules or syringes 50 contained inside the secondary case 20 are not exposed to light.

Furthermore, considering in particular that the lid 12 is reclosable but generally not effectively closed, the configuration of the improved container 1 according to the present invention makes it possible to prevent the ampoules or syringes 50 from accidentally exiting the seats 31 once the lid 12 is opened.

Again, the presence of the secondary lid 21 which is adherent above to the seats 31 keeps the ampoules or syringes 50 stably inside the seats 31 themselves, limiting the movements thereof both when the lid 12 is closed and when it is opened.

Figure 2:
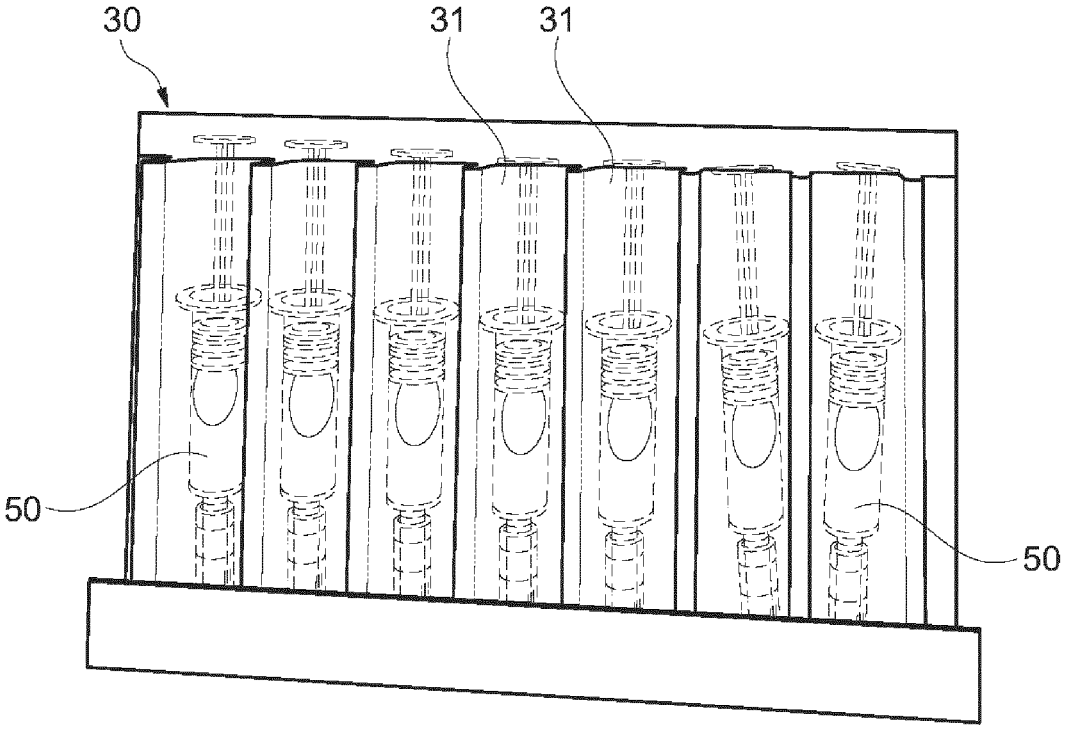
FIG. 2 shows a perspective view of the tray contained inside the container according to the present invention, which in turn contains, in the example shown, a plurality of syringes.

Returning to the configuration of the secondary case 20, as can be seen in particular from the example shown in FIG. 2, on said secondary lid 21 there are present, identified by corresponding break lines 22, a plurality of closure portions 23 defined by the same number of break lines 22, each of said closure portions 23 being placed at an ampoule or syringe 50 contained in said tray 30.

The fact that, after having opened the lid 12 of the primary case, in order to be able to access an ampoule or syringe 50 the user must also remove one of the closure portions 23 formed on the secondary lid 21 so as to have access exclusively to the single ampoule or syringe 50 underlying this closure portion 23, allows on the one hand, as mentioned, avoiding of exposure to light of all the ampoules or syringes 50 contained in the tray 30 whenever the lid 12 is opened to withdraw an ampoule or syringe 50, and on the other hand allows affixing on one or more of said closure portions 23 of said secondary lid 21 an identification mark 27 such as a numerical figure, as in the example of FIG. 1, or a letter, or to use a colour code to distinguish and identify specific ampoules or syringes 50 placed below the relative closure portion 23.

The improved container 1 for ampoules or syringes 50 according to the present invention thus allows identification of the single ampoules or syringes 50 contained therein, so that the user can be guided in the action of withdrawing a specific ampoule without, however, exposing the other ampoules to light and to the risk of them exiting from the tray 30 and from the container itself.

This may be particularly useful when the user has to extract from the container 1 a specific ampoule or syringe, for example to indicate the day of the week so that the user has immediate confirmation that they have taken the product every day, or in the case wherein they have to take different drugs at different times of the day, by resorting for example to a colour code, or similar circumstances.

It has thus been shown how the improved container 1 according to the present invention achieves the intended task and the objects set.

The container 1 according to the present invention may undergo modifications and variations, all of which fall within the scope of the invention as defined by the appended claims.

The invention claimed is:

1. Improved container for ampoules or syringes comprising a primary case provided with at least one opening closable by means of a primary lid, and a tray comprising a plurality of seats configured to accommodate the same number of ampoules or syringes, further comprising a secondary lid which defines, inside said primary case, a secondary case which, in turn, houses in its interior said tray, so that when said tray is inserted in said secondary case the ampoules or syringes contained therein face towards the inner face of said secondary lid, on said secondary lid being defined, at each ampoule or syringe below it, an access opening closed by a removable closure portion, characterised in that each of said closure portions comprises a gripping zone defined by means of a further transverse break line arranged transversely with respect to the width of the closure portion so that the user can break said further transverse break line by applying pressure at the surface of the gripping zone and more easily remove the closure portion in order to access the underlying ampoule or syringe.

2. Improved container according to the claim 1, characterised in that at least one of said closure portions comprises an identification mark or a colour code designed to distinguish it from the other closure portions.

3. Improved container according to claim 1, characterised in that each of said closure portions comprises an identification mark or a colour code designed to distinguish it from the other closure portions.

4. Improved container according to claim 3, characterised in that said primary case is box-shaped and said opening closable by means of said primary lid is a casket-like opening.

5. Improved container according to claim 1, characterized in that said secondary case is of a box shape suitable for being inserted inside said primary case.

6. Improved container according to claim 1, characterised in that on said secondary lid are provided, at the cells that accommodate said ampoules or syringes housed in the tray contained in said secondary case closed above by said secondary lid, break lines that define the shape of said closure portions of said access openings.

7. Improved container according to claim 6, characterised in that said access openings are of such a size as to allow the user, once said break line has been broken and said closure portion defined thereby has been removed, to access the ampoule or syringe below so as to be able to take it out.

8. Improved container according to claim 1, characterised in that said break lines are constituted by notches in said secondary lid interrupted by connecting elements that maintain the closure portion connected to the remaining portion of said secondary lid.

9. Improved container according to claim 1, characterised in that said secondary case and said primary case are made in card.

* * * * *